US007319841B2

(12) United States Patent
Bateman, III et al.

(10) Patent No.: US 7,319,841 B2
(45) Date of Patent: Jan. 15, 2008

(54) APPARATUS AND METHOD FOR CLEANING RESIDUAL TONER WITH A SCRAPER BLADE PERIODICALLY HELD IN CONTACT WITH A TONER TRANSFER SURFACE

(75) Inventors: William Ashmead Courtenay Bateman, III, Longmont, CO (US); Timothy Graham Bradley, Longmont, CO (US); Paul Douglas Fisher, Thornton, CO (US); William G. Jackson, Boulder, CO (US)

(73) Assignee: InfoPrint Solutions Company, LLC, Boulder, CO (US)

( * ) Notice: Subject to any disclaimer, the term of this patent is extended or adjusted under 35 U.S.C. 154(b) by 225 days.

(21) Appl. No.: 11/232,850

(22) Filed: Sep. 22, 2005

(65) Prior Publication Data

US 2007/0065195 A1 Mar. 22, 2007

(51) Int. Cl.
*G03G 21/00* (2006.01)

(52) U.S. Cl. ..... 399/345; 399/349; 399/351

(58) Field of Classification Search ..... 399/345, 399/349, 351

See application file for complete search history.

(56) References Cited

U.S. PATENT DOCUMENTS 3,986,227 A 10/1976 Fathergill et al.
4,451,139 A 5/1984 Yanagawa et al.
4,640,608 A 2/1987 Higaya et al.
4,969,015 A 11/1990 Saupe
4,984,028 A 1/1991 Tonomoto
4,989,047 A 1/1991 Jugle et al.
5,031,000 A 7/1991 Pozniakas et al.
5,053,827 A 10/1991 Tomkins et al.
5,066,983 A 11/1991 Tonomoto
5,083,169 A 1/1992 Usui et al.
5,339,149 A 8/1994 Lindblad et al.
5,416,572 A * 5/1995 Kolb et al. ..... 399/350
5,442,422 A 8/1995 Owens, Jr. et al.
5,652,948 A * 7/1997 Sakaguchi et al. ..... 399/71
5,832,355 A 11/1998 Kofferlein
6,564,034 B1 * 5/2003 Abe ..... 399/349
6,697,599 B2 2/2004 Scherdel
2004/0136763 A1 7/2004 Murakami et al.
2005/0069356 A1 * 3/2005 Drawe et al. ..... 399/349

FOREIGN PATENT DOCUMENTS

JP 60-083981 5/1985

* cited by examiner

*Primary Examiner*—David M. Gray
*Assistant Examiner*—Ryan D. Walsh
(74) *Attorney, Agent, or Firm*—Duft Bornsen & Fishman, LLP

(57) ABSTRACT

A cleaning station for removing residual toner from a moving toner transfer surface includes a rotating brush and a scraper blade that is held away from the toner transfer surface when toner images are being transferred to recording media, such as sheets of paper. On a periodic basis, when toner images are not being transferred to the recording media, the scraper blade is moved into contact with the toner transfer surface to remove agglomerated toner therefrom, with continued operation of the rotating brush.

9 Claims, 4 Drawing Sheets

FIG. 1
PRIOR ART
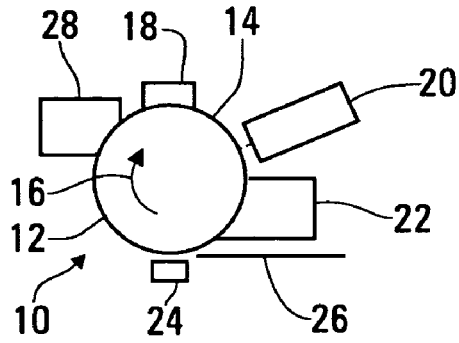
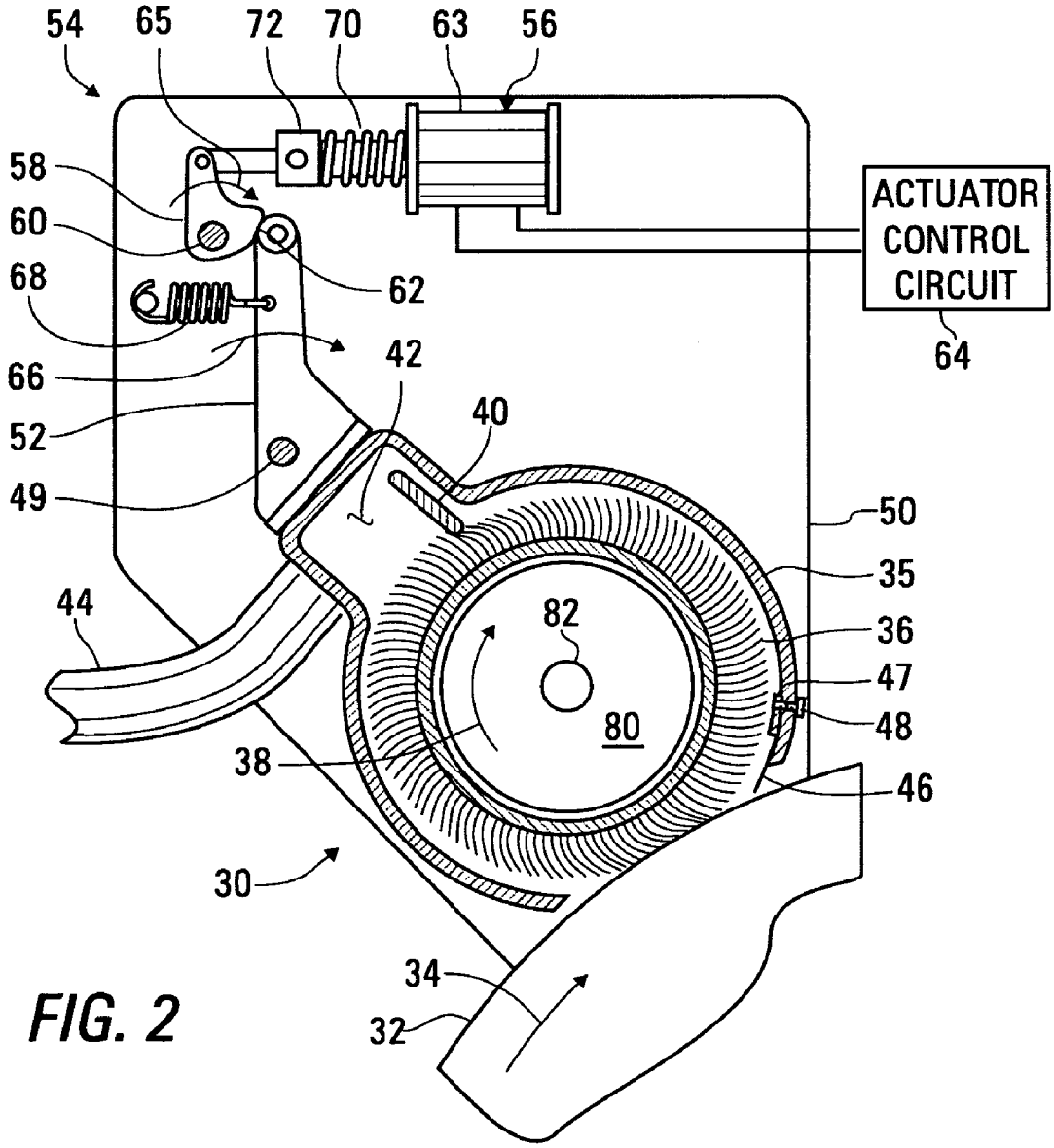
FIG. 2

APPARATUS AND METHOD FOR CLEANING RESIDUAL TONER WITH A SCRAPER BLADE PERIODICALLY HELD IN CONTACT WITH A TONER TRANSFER SURFACE

BACKGROUND OF THE INVENTION

1. Field of the Invention

This invention relates to removing residual toner from a toner transfer surface, and, more particularly to removing residual toner from a photoconductor surface of an electrophotographic printer.

2. Summary of the Background Information

FIG. 1 is a block diagram of a conventional electrophotographic printer 10, showing the major process stations arranged around a photoconductive element. For example, the photoconductive element comprises a photoconductive drum 12 having a peripheral surface 14 coated with a photoconductive material over an electrically grounded substrate, turning at a constant speed in the direction of arrow 16. Otherwise, a suitable photoconductive element may be a belt having an outer surface coated with a photoconductive material over an electrically conductive and grounded substrate.

The process of printing a document begins when an electrostatic charge is placed on the surface of the photoconductive drum 12 as it is moved past a charging station 18, which may include a number of wires extending adjacent to the surface of the drum 12, with the wires being held at an electrical potential sufficient to cause an electrical charge to be transferred to the surface of the drum 12. Next, at an exposure station 20, the surface of the electrophotographic drum 12 is exposed to an illuminated image that flows, or moves with the surface of the drum 12. For example, such an illuminated image may be produced by reflecting a modulated laser beam with a rotating mirror to repeatedly sweep across the surface of the photoconductive drum 12. The portions of the surface of the photoconductive drum 12 that are illuminated at the exposure station 18 become at least partially discharged, forming a latent image of charged and discharged areas, which is developed into a toned image as the surface of the photoconductive drum 12 is moved past a developing station 22, with its surface being exposed to electrically charged toner particles, which are preferentially attracted to either the charged or discharged areas of the surface of the drum 12 to form the toned image. For example, the electrostatic image may consist of discharged areas that are covered with toner particles while the adjacent undischarged areas remain essentially free of toner particles.

The toned image on the surface of the photoconductive drum 12 is then moved past a transfer station 24, in which toner from the toned image is transferred to a recording medium, such as a sheet of paper 26, which is moved into contact with the surface 14 of the rotating drum 12 at the transfer station 24. The transfer of the charged particles forming the toned image is generally aided by the application of an electric field between the surface of the photoconductive drum 12 and the side of the paper 24 opposite the surface moved against the drum 12. For example, a number of sheets of paper 24 may be fed in succession through the transfer station 22 to receive toned images generated in succession on the surface of the photoconductive drum 12. In general, some of the toner particles in the toned image are not transferred to the paper 24, leaving a residual image on the surface of the photoconductive drum 12. A cleaning station 28 is therefore provided to remove toner forming the residual image from the surface of the drum 12.

The electrophotographic printer 10 is an example of apparatus including a moving toner transfer surface, for example, the surface 14 of the photoconductive drum 12, on which a residual image is formed from which toner must be removed using a cleaning station. Such apparatus may be include a copying system in which a photoconductive surface is exposed to an image of an illuminated document formed by a lens. Otherwise, a moving toner transfer surface may be the surface of a drum on which images formed from differently colored toners are accumulated before a multicolored image is transferred to a recording medium, such as a sheet of paper.

A number of types of electrophotographic printers use a rotating brush, such as a fur brush, engaging the photoconductive drum within the cleaning station 26 to remove toner particles from the toned image. For example, toner particles loosened from the surface of the drum 12 are removed by a vacuum system to be held within a filter through which air from the vacuum system is exhausted. A disadvantage of the use of a rotating brush arises from the fact that toner particles may agglomerate into larger particles or into a toner film, both of which are not readily removable by the rotating brush. An additional disadvantage of the use of a rotating brush within the cleaning station arises from the fact that large particles of agglomerated toner can become stuck within the rotating brush instead of being removed by the vacuum system. Some electrophotographic printers alleviate this problem by implementing a brush conditioning cycle at times when printing is not taking place. For example, after a predetermined distance of the surface of the photoconductive drum, such as 10,000 feet of surface a brush conditioning cycle is run when it is determined that a pause has occurred within the printing process. During the brush conditioning cycle, the photoconductive drum and the rotating brush are driven, with a housing extending around the rotating brush being moved to contact the brush. When the brush conditioning cycle is completed, the housing is returned to its normal position, and the electrophotographic printing process is allowed to resume.

Other types of electrophotographic printers employ a scraper blade held against the moving surface of a photoconductive drum or belt to remove toner from the residual image. The scraper blade is typically composed of a soft plastic or an elastomeric material. Disadvantages associated with this method include the fact that the surface of the photoconductive drum or belt may become scratched by contact stresses occurring during the scraping process, from the fact that the scraper blade may become ineffective due to wear occurring at its line of contact with the surface of the photoconductive drum or belt or due to the relaxation of stresses due to creep occurring within the scraper blade. A further disadvantage arises from the fact that toner may become attached to the surface of the scraper blade.

The patent literature includes a number of descriptions of photoconductor cleaning stations including both a rotating brush and a scraper blade held against the photoconductor surface in a position following the brush. For example, U.S. Pat. No. 5,832,355 describes such a cleaning station having a stripper, or scraper blade composed of an abrasion-resistant plastic. U.S. Pat. No. 5,339,140 describes a photoconductor cleaning station having a pair of rotating brushes and a spots cleaning blade to remove residual agglomerations of particles from the imaging surface. The spots cleaning blade is made from a material, such as a urethane or polyester material, that has a low coefficient of friction compared to the soft plastic and elastomeric material previously used for photoconductor scraper blades. U.S. Pat. Nos. 4,989,047 and 5,031,000 describe the use of a secondary cleaning member, in the form of a thin scraper blade, used in association with a primary cleaning member in the form of a rotating brush, with the scraper blade being additionally characterized as having a low angle of attack with the photoconductor surface or as being loaded by means of a weight against the photoconductor surface. U.S. Pat. Nos. 4,984,028 and 5,066,983 describe a cleaning station including a rotating brush and a scraper blade disposed immediately following the brush, with toner being evacuated from the cleaning station by air sucked through a filter and an air pump from a housing structure surrounding the blade and the rotating brush. The cleaning station of U.S. Pat. No. 5,066,983 is further characterized by the continuous removal of larger particles of contamination accumulated and the cleaning edge of the blade by the rotating brush, while the smaller particles of contaminants serve to lubricate the area between the cleaning blade and the surface of the photoconductive drum. U.S. Pat. No. 4,451,139 describes a cleaning station including a rotating brush, a scraper blade, and a housing having provisions for removing the cleaning station without damaging the photoconductive surface.

Other patents, such as U.S. Pat. No. 4,640,608, describe photoconductor cleaning stations including both a rotating brush and a scraper blade that is moved into contact with the photoconductive drum as the rotation of the photoconductive drum is begun, or as the process of printing or copying a document is started, and that is moved out of contact with the photoconductive drum as the rotation of the drum is stopped, or as the process of printing or copying a document is completed.

U.S. Pat. No. 5,442,422 describes a cleaning station including a rotating brush, a scraper blade that is moved into, and out of, contact, and an additional sealing strip, disposed below the cleaning blade, that is moved into, and out of contact with the photoconductor. In particular, when the cleaning station is to be removed from the system for service with the scraper blade out of contact with the photoconductor, the sealing strip is first moved into contact with the photoconductor to prevent contamination of the system with residual toner from the cleaning station. U.S. Pat. No. 4,969,015 and Japanese Patent Application 60-083981 describe such a cleaning station including an additional scraper blade held against the side of the scraper blade as it is moved away from the photoconductor to remove deposits from the scraper blade that is used to clean the photoconductor.

U.S. Pat. No. 5,083,169 describes a cleaning station without a scraper blade, in which a fur brush mounted on a pivot arm is moved into contact with the photoconductor each time a predetermined number of copies of a document have been printed and after the copier is turned off.

The patent literature additionally includes descriptions of cleaning stations using scraper blades without associated rotating brushes. For example, U.S. Patent App. Pub. 2004/0136763 A1 describes a cleaning unit including first and second scraper blades, with the first blade removing adhered substances and with the second blade, following the first blade, having an abrasive layer that is formed by including abrasive particles within an elastic material. U.S. Pat. No. 5,053,827 describes a scraper blade that is moved into contact with a surface carrying a residual image only during the passage of the residual image when it needs to be removed. U.S. Pat. No. 6,697,599 describes a scraper blade that is supported in a region where it is bent to be held against the photoconductor at a leading edge of the scraper blade and additionally adjacent the bend region.

SUMMARY OF THE INVENTION

Accordingly, it is a first objective of the invention to provide a means for conditioning a toner transfer surface with a scraper blade that is held against the photoconductor surface only during a conditioning cycle while documents are not being printed.

It is a second objective of the invention to provide a means for simultaneously conditioning a cleaning brush and the toner transfer surface during a conditioning cycle while a process of transferring toner to recording media is not occurring.

In accordance with one aspect of the invention, apparatus is provided for cleaning a residual image from a moving toner transfer surface. The apparatus includes a housing, a brush, a scraper blade, an actuator, and control means. The brush is rotated within the housing in contact with the toner transfer surface. The scraper blade is movably mounted to extend adjacent the moving toner transfer surface. The actuator moves the scraper blade between a first position, in which the scraper blade is held out of contact with the moving toner transfer surface, and a second position, in which the scraper blade is moved into contact with the moving toner transfer surface. The control means causes the actuator to move the scraper blade from the first position to the second position periodically and to then hold the scraper blade in the second position for a predetermined time. The scraper blade may be attached to the housing, with a portion of the housing being moved into contact with the brush as the scraper blade is moved into the second position.

In accordance with another aspect of the invention, a method is provided for removing toner from residual images on a moving toner transfer surface. The method begins with determining that toner has been transferred from the moving toner transfer surface to recording media for a first predetermined interval with a brush rotating in engagement with the toner transfer surface and with a scraper blade being held out of contact with the moving toner transfer surface. Then, the scraper blade is moved into contact with the moving toner transfer surface, to be held in contact with the moving toner transfer surface for a second predetermined angle. Then, the scraper blade is moved away from the moving toner transfer surface. The method may additionally include determining that a process of transferring toner from the moving toner transfer surface to the recording media has been completed before moving the scraper blade into contact with the moving toner transfer surface.

BRIEF DESCRIPTION OF THE FIGURES

FIG. 1 is a schematic diagram of a conventional electrophotographic printer;

FIG. 2 is a transverse cross-sectional elevation of a cleaning station built in accordance with a first embodiment of the invention operating in a mode for transferring toner to recording media;

DETAILED DESCRIPTION OF THE INVENTION

Figure 3:
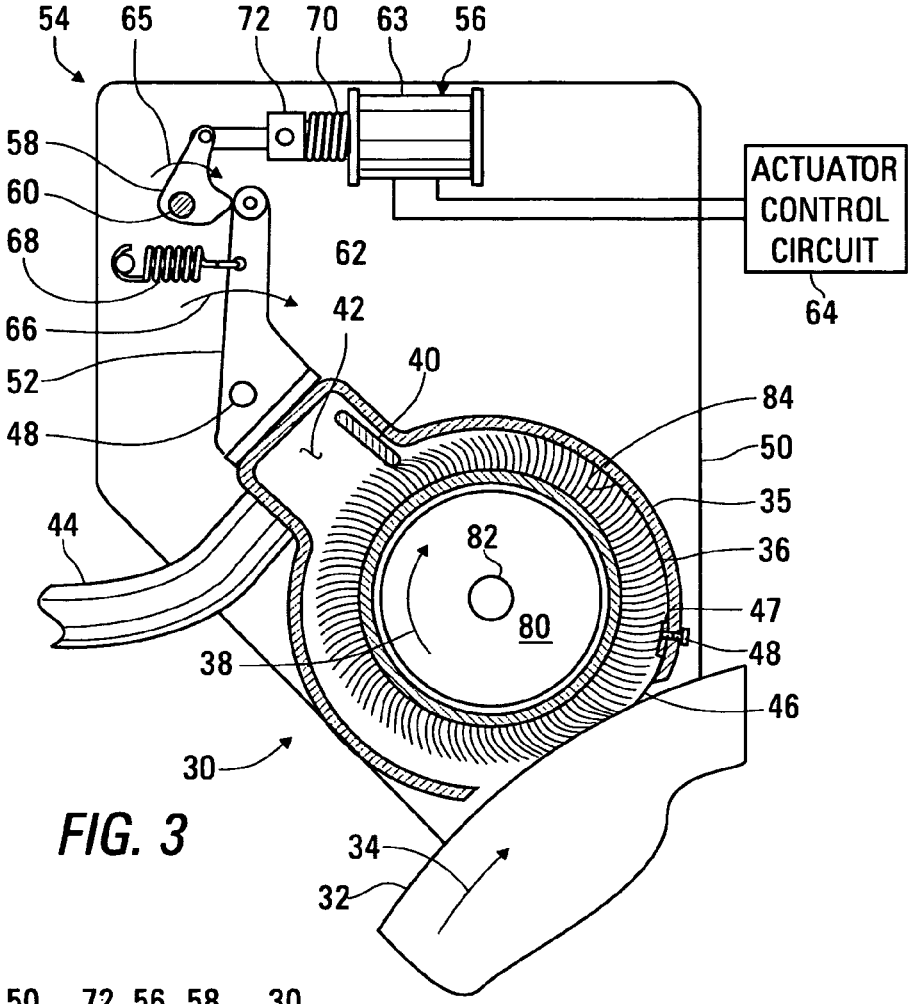
FIG. 3 is a transverse cross-sectional elevation of the cleaning station of FIG. 2 operating in a surface conditioning mode.

FIG. 2 is a transverse cross-sectional elevation of a cleaning station 30 built in accordance with a first embodiment of the present invention, shown as operating in a cleaning mode to remove residual toned images from a toner transfer surface 32, moving in the direction of arrow 34. The cleaning station 30 includes a housing 35, a brush 36, turning in the direction of arrow 38 engaging the toner transfer surface 32 and additionally engaging a flicker bar 40. Toner particles removed from the toner transfer surface 32 are entrained within air flowing within the housing 35, moving through a duct 42 to be captured within a filter (not shown) as air is sucked through the filter and a hose 44 connected to the duct 42. In accordance with the first embodiment the invention, the cleaning station 30 further includes a scraper blade 46 that is held, in a first position, as shown in FIG. 2, out of contact with the toner transfer surface 32 during the process of transferring toner images to recording media, such as sheets of paper elsewhere in the system of which the cleaning station 30 is a part.

FIG. 3 is a transverse cross-sectional elevation of the cleaning station 30, shown as operating in a drum conditioning mode, with the scraper blade 46 being held in a second position against the toner transfer surface 32 as this surface 32 continues to move in the direction of arrow 34.

The scraper blade 46 is attached to the housing 35, For example, the scraper blade 46 may be held in place by an adhesive layer extending adjacent the housing 35 and additionally by a clamping plate 47, attached to the housing 35 by a number of screws 48. The housing 35 is in turn movably mounted to pivot about a shaft 49 extending between a pair of end plates, of which a rear end plate 50 is shown. The housing is pivotally attached to the shaft 49 by means of a pair of mounting brackets, of which a rear mounting bracket 52 is shown. The cleaning station 30 includes an actuator 54 for moving the housing 35 with the scraper blade 46 between the position shown in FIG. 2 and the position shown in FIG. 3. The actuator 54 includes a solenoid 56 moving a crank 58 attached to a shaft 60 through a pivoting motion, with the shaft 60 pivoting within the rear end plate 50. The crank 58 includes a cam surface 62 engaging the rear mounting bracket 52, so that, when electrical current is driven through the coil 63 of the solenoid 56 by an actuator control circuit 64, pivoting movement of the crank 58 in the direction of arrow 65 causes pivoting movement of the rear mounting bracket 52, and of the housing 35 attached thereto, in the direction of arrow 66, with the scraper blade 46 being moved from its first position, shown in FIG. 2, to its second position, shown in FIG. 3. An extension spring 68 holds the rear mounting bracket 52 against the cam surface 62 of the crank 58, and a compression spring 70 is provided to return the plunger 72 of the solenoid 56 to the position in which it is shown in FIG. 2, when current no longer flows through the solenoid coil 63.

The scraper blade 46, which is composed, for example, of a polyethylene terephthalate resin sold by DuPont under the tradename MYLAR, bends as a cantilever spring as it is brought into contact with the toner transfer surface 32.

Figure 4:
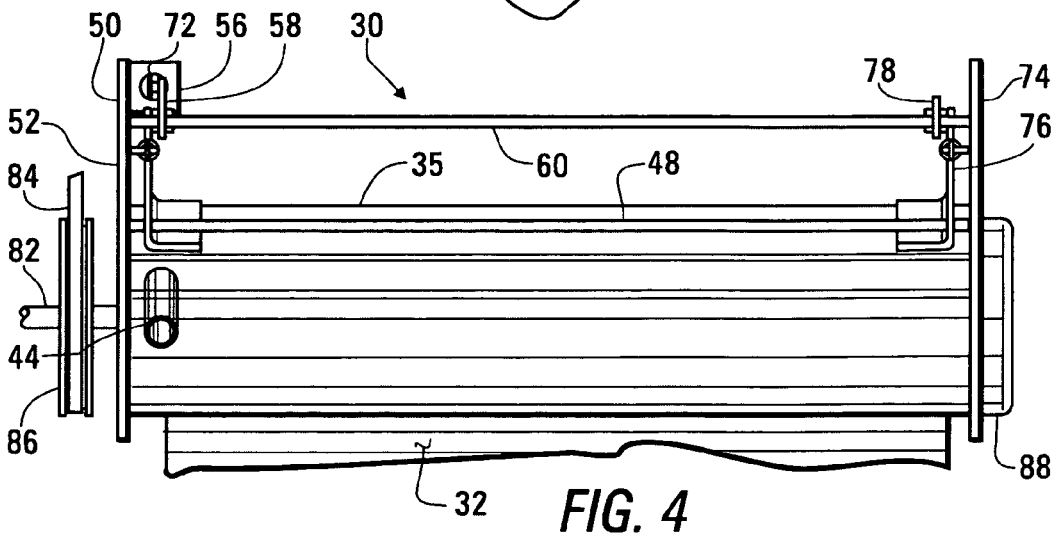
FIG. 4 is a left elevation of the cleaning station of FIG. 3.

FIG. 4 is a left elevation of the cleaning station 30. The housing 35 extends between the rear end plate 50 and a front end plate 74, being pivotally mounted on the shaft 49 extending between the end plates 50, 74 by means of the rear mounting bracket 52, and additionally by means of a front mounting bracket 76. The shaft 60 transmits the movement imparted by the single solenoid 56 from the crank 58 to another crank 78 attached to the shaft 60. The crank 78 has a cam surface, similar to the cam surface 62 of the crank 58, which engages the front mounting bracket 76 so that both ends of the housing 36 are similarly pivoted in response to movement of the solenoid plunger 72.

The brush 36 is driven in rotation by a tapered rear spindle 80, attached to a drive shaft 82 that is rotatably mounted in the rear end plate 50. The drive shaft 82 is in turn driven in rotation by a belt 84 engaging a pulley 86. The front end of the brush 36 is rotatably mounted by a spindle (not shown) in an end cap 88, which is removably attached to the front end plate 74 to provide for removal and replacement of the brush 36. Thus, operation of the solenoid 56 does not result in movement of the brush 36, but rather in movement of the housing 35 relative to the brush 36, so that rubbing contact occurs between a portion 84 of the inner surface of the housing and the rotating brush 36. This rubbing contact is used, for example, to compress the fibers of the rotating brush 36 so that toner not removed from the brush 36 during normal operation of the cleaning station 30, as shown in FIG. 2, can be removed with periodic operation in a conditioning cycle, as shown in FIG. 3.

Figure 5:
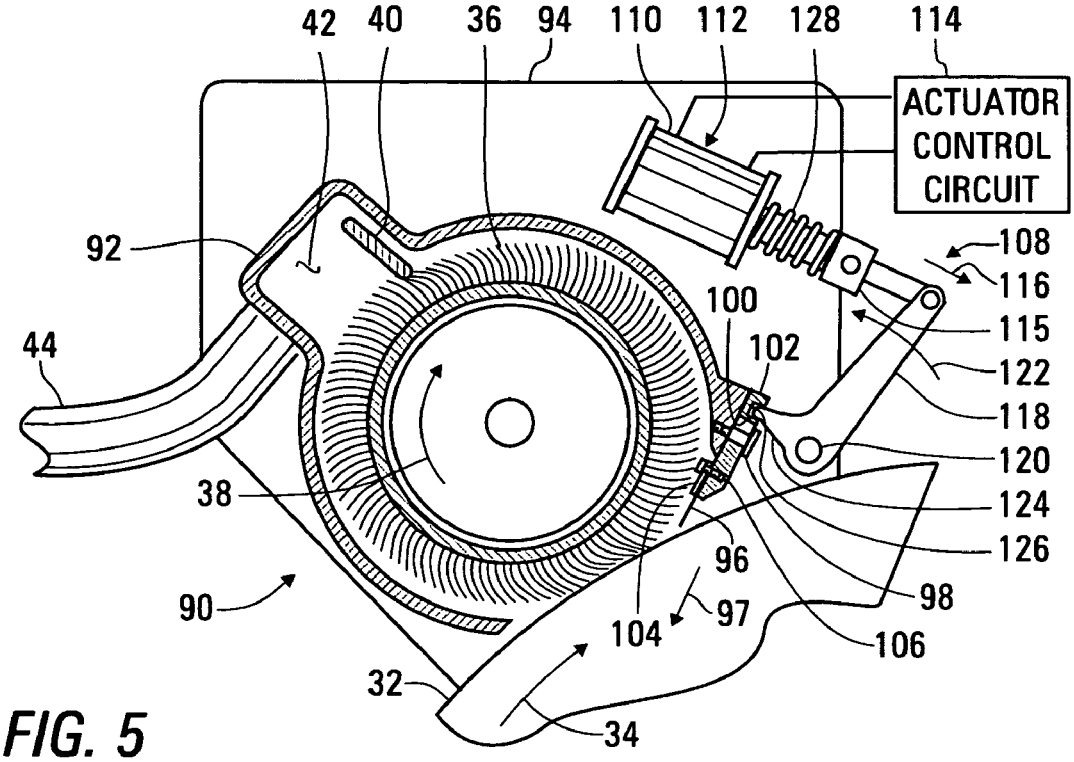
FIG. 5 is a transverse cross-sectional elevation of a cleaning station built in accordance with a second embodiment of the invention operating in the mode for transferring toner to recording media.

FIG. 5 is a transverse cross-sectional elevation of a cleaning station 90 built in accordance with a second embodiment of the invention, shown as operating in a cleaning mode. The cleaning station 90 has a number of elements that are similar or identical to the elements of the cleaning station 30, which has been described above in reference to FIGS. 2-4. Such similar or identical elements are therefore accorded like reference numbers. For example, the cleaning station 90 includes a brush 36, turning in the direction of arrow 38 to remove residual toned images from a toner transfer surface 32 moving in the direction of arrow 34, with the brush 36 additionally engaging a flicker bar 40. Toner particles entrained within air flowing within the cleaning station 90 are removed by air flowing through a duct 42 and through a hose 44.

However, the housing 92 of the cleaning station 90 is attached to remain stationary between a pair of end plates, of which the rear end plate 94 is shown. In accordance with the second embodiment of the invention, the cleaning station 90 includes a scraper blade 96 that is movably mounted on the housing 92, to move toward the toner transfer surface 32, in the direction of arrow 97, and to move away from the toner transfer surface 32, opposite the direction of arrow 97, by a number of shoulder screws 98, which extend through slots 100 in an elongated holder 102. For example, the scraper blade 96 is attached to the elongated holder 102 by means of an adhesive layer between the scraper blade 96 and the elongated holder 102, and additionally by a clamping bar 104 attached to the elongated holder 102 by means of a number of screws 106. Preferably, while residual toner images are being generated in a process transferring a toner image to recording media, the scraper blade 96 is held in a first position, as shown in FIG. 5, being spaced away from the toner transfer surface 32.

Figure 6:
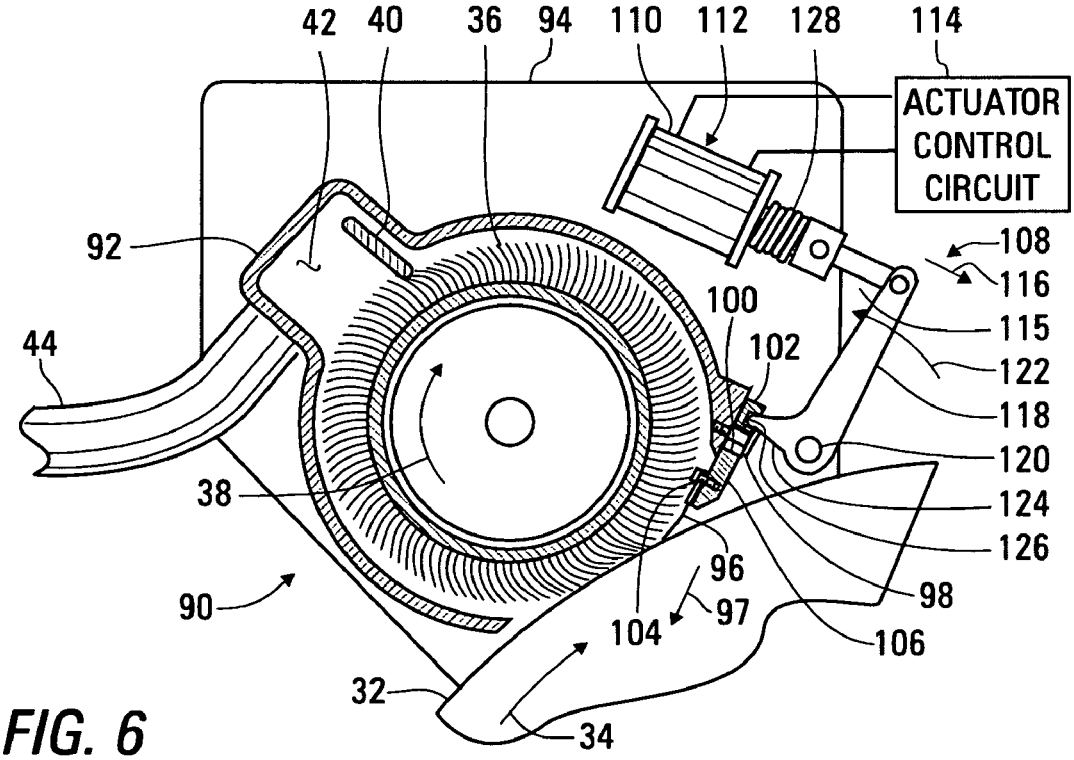
FIG. 6 is a transverse cross-sectional elevation of the cleaning station of FIG. 4 operating in a surface conditioning mode.

FIG. 6 is a transverse cross sectional elevation of the cleaning station 90, shown as operating in a drum conditioning mode, with the scraper blade 96 being held in a second position, against the toner transfer surface 32 as the toner transfer surface 32 continues to move in the direction of arrow 34.

The cleaning station 90 additionally includes an actuator 108, configured to move the scraper blade holder 102 so that the scraper blade is moved between its first position, as shown in FIG. 5, and its second position, as shown in FIG. 6, when electrical current is driven through a coil 110 within a solenoid 112 by an actuator control circuit 114. The application of current through the coil 110 causes the solenoid plunger 115 to move in the direction of arrow 116, so that a crank 118, attached to a shaft 120 pivotally mounted on the rear end plate 94, pivots in the direction of arrow 122. The crank 118 includes a tip 124 extending into a slot 126 within the holder 102, so that the pivoting movement of the crank 118 in the direction of arrow 122 causes the holder 102 to move in the direction of arrow 97, with the scraper blade 96 being driven into contact with the toner transfer surface 32. When electrical current is no longer applied through the coil 110, a compression spring 128 moves the plunger 115 opposite the direction of arrow 118, so that the holder 102 is moved opposite the direction of arrow 97, with the scraper blade 96 being moved out of contact with the toner transfer surface 32.

The actuator control circuit 64, shown in FIGS. 2 and 3, and the actuator control circuit 114, shown in FIGS. 5 and 6, are implemented, for example, using a processor executing instructions to control the system, such as an electrophotographic printer, in which the cleaning station 30, 90 is operating. According to the invention, a surface conditioning mode occurs periodically to condition the toner transfer surface 32 by moving this surface for a predetermined time past the cleaning station 30, 90 with the scraper blade 46, 96 held in contact with the surface 32. Preferably, this does not occur while toner is transferred from the surface 32 to the recording medium.

Figure 7:
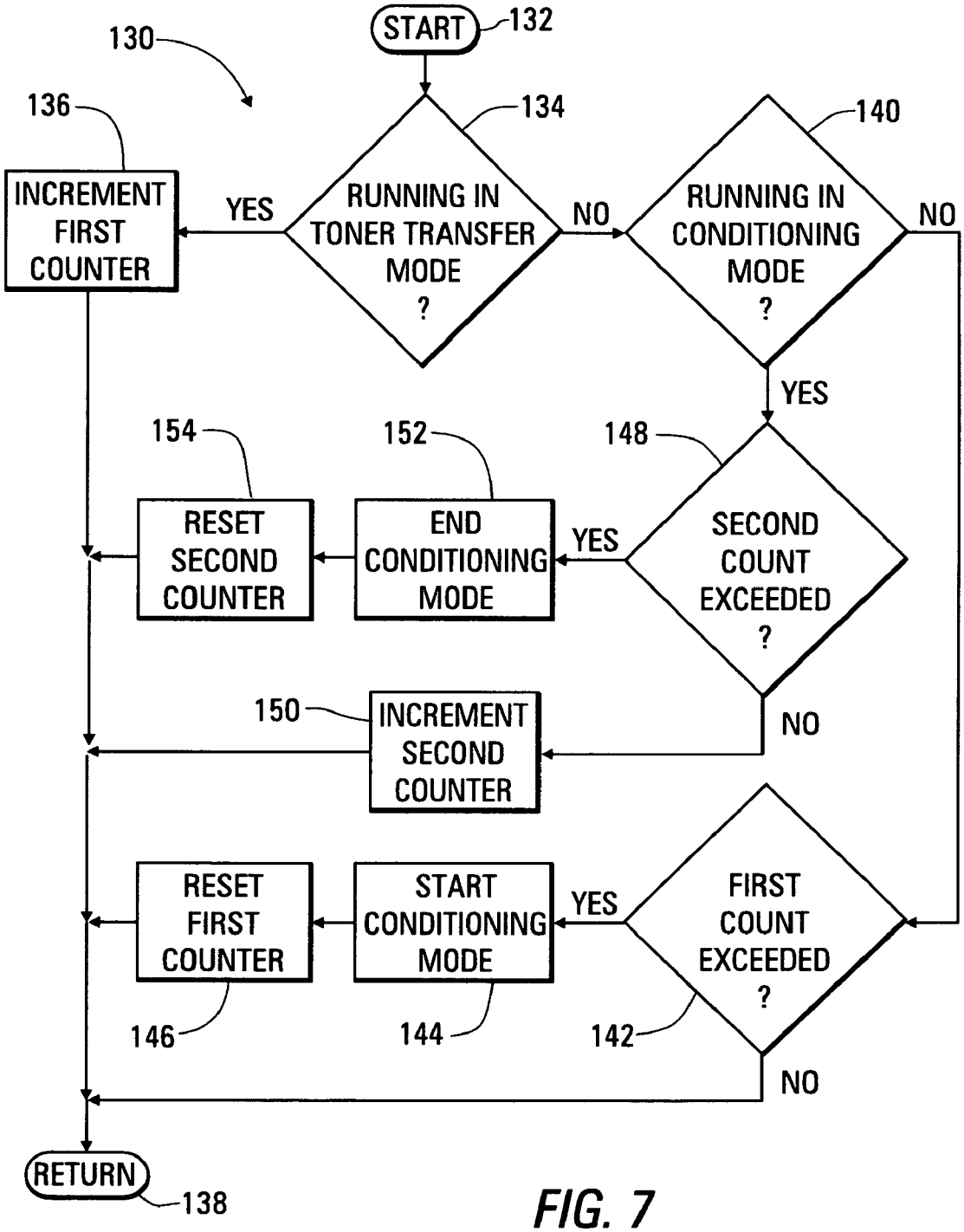
FIG. 7 is a flow chart of processes occurring during execution of a subroutine to control the operation of the cleaning station of FIG. 2 or the cleaning station of FIG. 5.

FIG. 7 is a flow chart of processes occurring during the execution of an exemplary subroutine 130 within such a processor to provide for removing toner from the toner transfer surface 32. The subroutine is called to start in step 132 by a routine executing within the processor in response to a timing pulse. Then, in step 134, a determination is made of whether the system is operating in a toner transfer mode, such as the printing mode of an electrophotographic printer system. If the system is operating in a toner transferring mode, an incremental value, such as one, is added to a first counter variable in step 136 before the subroutine 130 ends, returning to the calling routine, in step 138. Since the timing pulses that start the subroutine 130 in step 132 occur at a constant rate, and since the movement of the toner transfer surface 32 occurs at an essentially constant and known speed, the number of such pulses counted provides a reliable indication of the distance through which the toner transfer surface 32 has been driven by each of the associated processing stations within the system. Thus, a first count level is established as corresponding to a predetermined time interval and to a predetermined distance through which the toner transfer surface 32 is driven before operation in the surface conditioning mode is begun.

While the first count level is typically reached during operation in the mode in which toner is transferred to the recording medium, such as the printing mode of an electrophotographic printer, such a process is allowed to continue without interruption to begin a surface conditioning cycle. On the other hand, when it is determined in step 134 that the system is not running in the toner transfer mode, a further determination is made in step 140 of whether the system is running in the surface conditioning mode. If it is not, the subroutine 130 proceeds to step 142, in which it is determined whether the first count has been exceeded by the number value of the first counter variable. If it has been exceeded, the surface conditioning mode is started in step 144, and the first counter variable is reset in step 146. In this way, a determination is made that the process of transferring toner from the toner transfer surface 32 has been completed before the scraper blade 46, 96 is moved into contact with this surface 32 to start the surface conditioning mode.

During operation in the surface conditioning mode, electrical current is driven through the solenoid coil 63, 110, so that the scraper blade 46, 96 is held in contact with the toner transfer surface 32 as this surface 32 continues to be driven in the direction of arrow 34. When the system is operating in the mode in which toner is transferred to the recording member, such as the printing mode of an electrophotographic printer, electrical current is not driven through the solenoid coil 63, 110, so that the scraper blade 46, 96 is held out of contact with the toner transfer surface 32 as this surface 32 is moved as required in the performance of the toner transferring process. During both the mode in which toner is transferred to the recording medium and during the surface conditioning mode, the toner transfer surface 32 is moved at a constant speed in the direction of arrow 34, and the brush 36 is rotated at a constant speed in the direction of arrow 38.

Since the movement of the toner transfer surface 32 occurs at an essentially constant and known speed during the surface conditioning process, the timing pulses that start the subroutine 130 in step 132, which occur at a constant rate, can be used to provide a reliable indication of the distance through which the toner transfer surface 32 moves with the system operating in the surface conditioning mode. Thus, during operation in the surface conditioning mode, such pulses are counted, with the count being stored in a second counter variable, while a second count level is established as corresponding to a predetermined time interval and to a predetermined distance through which the toner transfer surface 32 is driven before operation in the surface conditioning mode is ended.

When it is determined in step 140 that the system is running in the surface conditioning mode, the subroutine 130 proceeds to step 148, in which a further determination is made of whether the second count level has been exceeded. If it has not been exceeded, an incremental value, such as one, is added to the second counter value in step 150. If it has been exceeded, the surface conditioning mode is ended in step 152, with the flow of electrical current through the solenoid coil 63, 110 being stopped so that the scraper blade 46, 96 being moved out of contact with the toner transfer surface 32, and with movement of the toner transfer surface 32 being stopped. Then, in step 154, the second counter is reset.

The method of the invention has advantages over the prior art methods in which a scraper blade is removed from a toner transfer surface only when the movement of the toner transfer surface is stopped, arising from the fact than, in accordance with the present invention, the scraper blade is held out of contact with the toner transfer surface during operation of the system in the toner transfer, i.e. printing, mode. With the use of the present invention, damage to the photoconductor, such as scratching, with contact with the scraper blade, and wear to the edge of the scraper blade is minimized, while the scraper blade is brought into use often enough to remove agglomerations of toner accumulating on the transfer surface.

While the invention has been described in terms of its preferred embodiments with some degree of particularity, it is understood that this description has been given only by way of example, and that many changes can be achieved without departing from the spirit and scope of the invention, as described in the appended claims.

What is claimed is:

1. An apparatus for cleaning a residual image from a moving toner transfer surface, wherein the apparatus comprises:

a housing;

a brush rotated within the housing in contact with the toner transfer surface;

a scraper blade movably mounted to extend adjacent the moving toner transfer surface;

an actuator moving the scraper blade between a first position, in which the scraper blade is held out of contact with the moving toner transfer surface, and a second position, in which the scraper blade is moved into contact with the moving toner transfer surface; and control means causing the actuator to move the scraper blade from the first position to the second position periodically and to then hold the scraper blade in the second position for a predetermined time, wherein the scraper blade is attached to the housing, the housing is movably mounted, and the actuator moves the housing to move the scraper blade between the first and second positions.

2. The apparatus of claim 1, wherein a portion of the housing is moved into contact with the brush as the scraper blade is moved into the second position.

3. The apparatus of claim 1, wherein the scraper blade comprises a polyethylene terephalate resin.

4. An apparatus comprising:

a moving toner transfer surface, a developer transferring a toned image to the moving toner transfer surface;

a transfer station transferring toner from the toned image to a recording medium and leaving toner on the moving toner transfer surface in a residual image; and a cleaning station removing toner from the residual image on the toner transfer surface, wherein the cleaning station includes:

a housing;

a brush rotated within the housing in contact with the toner transfer surface;

a scraper blade movably mounted to extend adjacent the moving toner transfer surface;

an actuator moving the scraper blade between a first position, in which the scraper blade is held out of contact with the moving toner transfer surface, and a second position, in which the scraper blade is moved into contact with the moving toner transfer surface; and control means causing the actuator to move the scraper blade from the first portion to the second position periodically and to then hold the scraper blade in the second position for a predetermined time;

wherein the scraper blade is attached to the housing, the housing is movably mounted, and the actuator moves the housing to move the scraper blade between the first and second positions.

5. The apparatus of claim 4, wherein a portion of the housing is moved into contact with the brush as the scraper blade is moved into the second position.

6. The apparatus of claim 4, wherein the scraper blade comprises a polyethylene terephthalate resin.

7. The apparatus of claim 4, wherein the control means causes the actuator to move from the first position to the second position on a periodic basis in response to an indication that a process of transferring toner from the toner transfer surface to the recording media has been completed.

8. A method for removing toner from residual images on a moving toner transfer surface, wherein the method comprises:

determining that toner has been transferred from the moving toner transfer surface to recording media for a first predetermined interval with a brush rotating in engagement with the toner transfer surface and with a scraper blade being held out of contact with the moving toner transfer surface, the scraper blade being attached to a housing of the brush;

moving the housing to initiate contact between the scraper blade and the moving toner transfer surface, holding the scraper blade in contact with the moving toner transfer surface for a second predetermined interval; and moving the scraper blade away from the moving toner transfer surface.

9. The method of claim 8, additionally comprising determining that a process of transferring toner from the moving toner transfer surface to the recording media has been completed before moving the scraper blade into contact with the moving toner transfer surface.

* * * * *

UNITED STATES PATENT AND TRADEMARK OFFICE

CERTIFICATE OF CORRECTION

PATENT NO. : 7,319,841 B2
APPLICATION NO. : 11/232850
DATED : January 15, 2008
INVENTOR(S) : Bateman, III et al.

It is certified that error appears in the above-identified patent and that said Letters Patent is hereby corrected as shown below:

In Claim 4, column 10, line 8 should read:

--blade from the first <u>position</u> to the second position--

Signed and Sealed this

Tenth Day of June, 2008

JON W. DUDAS
*Director of the United States Patent and Trademark Office*